United States Patent [19]

Wileman, III

[11] Patent Number: 4,745,639

[45] Date of Patent: May 24, 1988

[54] TOILET APPARATUS WITH AUTOMATIC SELF-CLEANING MEANS

[75] Inventor: Ben C. Wileman, III, Oklahoma City, Okla.

[73] Assignee: Wileman Industries, Inc., Oklahoma City, Okla.

[21] Appl. No.: 874,667

[22] Filed: Jun. 16, 1986

[51] Int. Cl.[4] ..... A47K 13/00

[52] U.S. Cl. ..... 4/233; 4/662

[58] Field of Search ..... 4/233, 661, 229, 223, 4/222, 662

[56] References Cited

U.S. PATENT DOCUMENTS

| | | | |
|---|---|---|---|
| 1,492,825 | 5/1924 | Abbott | 4/233 |
| 2,961,664 | 11/1960 | Davidson | 4/229 |
| 3,316,559 | 5/1967 | Ewing et al. | 4/223 |
| 3,801,999 | 4/1974 | McNally | 4/229 |
| 4,063,316 | 12/1977 | Hunninghaus | 4/233 |
| 4,183,105 | 1/1980 | Womack | 4/661 |
| 4,216,553 | 8/1980 | Haberle | 4/233 X |

FOREIGN PATENT DOCUMENTS

| | | | |
|---|---|---|---|
| 2132688 | 1/1972 | Fed. Rep. of Germany | 4/233 |
| 2907754 | 9/1980 | Fed. Rep. of Germany | 4/233 |
| 685998 | 1/1953 | United Kingdom | 4/233 |

*Primary Examiner*—Henry K. Artis

[57] ABSTRACT

In a toilet apparatus comprising a bowl, a seat member adapted to overlie rim portions of the bowl, and a cover member adapted to overlie the seat member, the improvement comprising channels disposed in the seat member and cover member, a plurality of holes extending from the channels to the undersurfaces of the seat and cover members respectively, and fluid conveying means interconnecting the channels with fluid source means, whereby fluid means may be conveyed by the channels and holes and directed against the rim of the bowl and an upper surface of the seat member to effect cleaning thereof.

7 Claims, 19 Drawing Sheets

TOILET APPARATUS WITH AUTOMATIC SELF-CLEANING MEANS

BACKGROUND OF THE INVENTION

1. Field of Invention

The invention relates to the automatic cleaning of a toilet apparatus, and is directed more particularly to means for effecting cleaning of exposed surfaces of a toilet apparatus.

2. Description of the Prior Art

Devices for the cleaning of toilet bowls and seats are generally well known. The cleaning of bowls is usually accomplished by the introduction of a cleaning agent into water in the bowl. A common approach is to mount a reservoir of cleaning agent in the holding tank so that when the toilet is flushed, chemically treated water enters the bowl. Another approach is to provide special structure for directing chemically treated water into the bowl, as is illustrated in U.S. Pat. No. 4,183,105. Still another approach is to provide, as an accessory, an add-on item whose purpose is to introduce a cleaning agent into the bowl. U.S. Pat. No. 3,316,559 is illustrative of such an accessory item.

The cleaning and/or disinfecting of toilet seats is generally accomplished by providing a conduit within the seat, and holes in the upper surface of the seat in communication with the conduit, so that disinfectant in the conduit may, but way of the holes, find its way to the upper seat surface to effect disinfecting thereof. U.S. Pat. Nos. 1,492,825 and 3,801,999 are illustrative of this type of device.

SUMMARY OF THE INVENTION

An object of the present invention is to provide a self-cleaning toilet apparatus adapted to wash and dry the upper bowl rim surface.

Another object of the invention is to provide such apparatus as is further adapted to wash and dry the upper seat surface of the apparatus.

A further object of the invention is to provide control means for effecting first a washing operation, followed by a drying operation, the control means being selectively operable to effect the washing and drying operation or facilitate normal operation of the toilet apparatus without the washing and drying function.

A still further object is to provide, as part of the electrical generation system, a switch system including an electrical switch moveable as a unit from a position in which it is subject to actuation by contact to a position in which it cannot be so actuated.

A still further object of the invention is to provide automatic sealing means for sealing the seat and seat cover members so that during a washing operation the water used in the washing function is directed into the bowl and not permitted outside the bowl.

With the above and other objects in view, as will hereinafter appear, a feature of the present invention is the provision of a toilet apparatus comprising a bowl, and a seat member adapted to overlie rim portions of the bowl, a channel disposed in the seat member, a plurality of holes extending from the channel to undersurface portions of the seat member overlying the rim portions of the bowl, and fluid conveying means interconnecting fluid source means with the seat member conduit, whereby fluid from the source means may pass through the conveying means, the seat member channel, and the holes, and be directed onto the rim portions of the bowl.

In accordance with another feature of the invention, there is provided a toilet apparatus comprising a bowl, a seat member adapted to overlie rim portions of the bowl, and a cover member adapted to overlie the seat member, a channel disposed in the cover member, a plurality of holes extending from the channel to undersurface portions of the cover member overlying the seat member, and fluid conveying means interconnecting fluid source means with the cover member channel, whereby fluid from the source means may pass through the conveying means, the cover member channel, and the holes and be directed onto an upper surface of the seat member.

In accordance with a further feature of the invention, there is provided in a self-cleaning toilet apparatus having a bowl, a holding tank, a seat member adapted to overlie rim portions of the bowl, and a cover member adapted to overlie the seat member, in which at least one of the seat and cover members has channel means therein and hole means extending from the channel means to an undersurface thereof to facilitate the passage of fluid through the channel and hole means, and which is adapted to have firstly a liquid passed therethrough, and secondly a gas (preferably heated air) passed therethrough, a control unit comprising a housing, liquid conveying means from a water source disposed in the housing, valve means in the housing for facilitating communication of the liquid conveying means with the channel means, gas conveying means from a gas source disposed in the housing, the valve means being further adapted to facilitate communication of the gas conveying means with the channel means, and means for actuating conveyance of the gas after completion of conveyance of the liquid.

In accordance with a still further feature of the invention, there is provided in an apparatus in which a momentary electrical current is required during movement of a member of the apparatus, a circuit actuation assembly comprising a track for the moving member, means for moving the moving member in a first direction along the track, a switch arm disposed along the path of movement of the member, a gear means disposed adjacent the path of movement of the member, the member having thereon a switch actuation portion and a gear track portion, the switch actuation portion being operative to actuate the switch substantially simultaneously with engagement of the gear means by the gear track portion, and a motor mounted in the assembly, a rod extending from a core portion of the motor, a rotary gear fixed to the rod, the rotary gear being engaged with the gear means, the switch being operable to activate the motor, and to provide a momentary electrical current for operation of electrically powered apparatus, the speed of the motor determining the rate of travel of the moving member, the moving member being further operable upon further movement in said first direction to deactivate the switch to stop operation of the motor and to terminate the flow of the momentary current.

In accordance with a still further feature of the invention, there is provided in an apparatus including a linearly moveable member, and a switch arm adapted to be engaged by a switch actuation portion of the member when the member moves in a first direction, and in which the member is required to move in a second direction opposite to the first direction, and in which it is desired that the moveable member not contact the switch arm when the member moves in the second direction, an assembly for moving the switch as a unit from a first position in which the arm is disposed in the path of the switch actuation portion of the member to a second position in which the arm is removed from the path of the switch actuation portion of the member, the assembly comprising a switch on which the arm is mounted, a swivel plate on which the switch is mounted, the plate being pivotally mounted, a connector mount fixed to the switch, a flexible connector extending from the connector mount and attached at a distal end to an end of a return actuator for the moveable member, the return actuator being moveable to urge the moveable member in the second direction, whereby the movement of the return actuator urges movement of the moveable member in the second direction and at the same time pulls the connector to cause rotation of the connector mount and the swivel plate and the switch, and thereby movement of the switch arm to the second position.

In accordance with a still further feature of the invention, there is provided in a toilet apparatus having self-cleaning means including the ejection of fluid against a bowl rim surface and/or a seat member surface, a sealing assembly for preventing escape of the fluid out of a chamber formed by the bowl, the seat member, and a cover member, the assembly comprising a housing fixed to the exterior of the bowl proximate the rim surface, a projection extending inwardly of the housing from a vertical wall thereof, a slide member disposed in the housing, the slide member having elongated slot means therein, the projection extending through the slot means such that a portion of the projection is disposed in the slide member dividing the slide member into upper and lower chambers, an inflatable upper tube disposed in the upper chamber, an inflatable lower tube disposed in the lower chamber, and means for selectively inflating one of the tubes while deflating the other of the tubes, whereby to move the slide member in the housing selectively downwardly to a position removed from the rim portion, or upwardly to a position in which an upper surface of the slide member abuts an undersurface of the cover member to effect a seal therebetween.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawing in which are shown an illustrative embodiment of the invention from which its novel features and advantages will be apparent.

In the drawings.

DESCRIPTION OF THE PREFERRED EMBODIMENT

Figure 1:
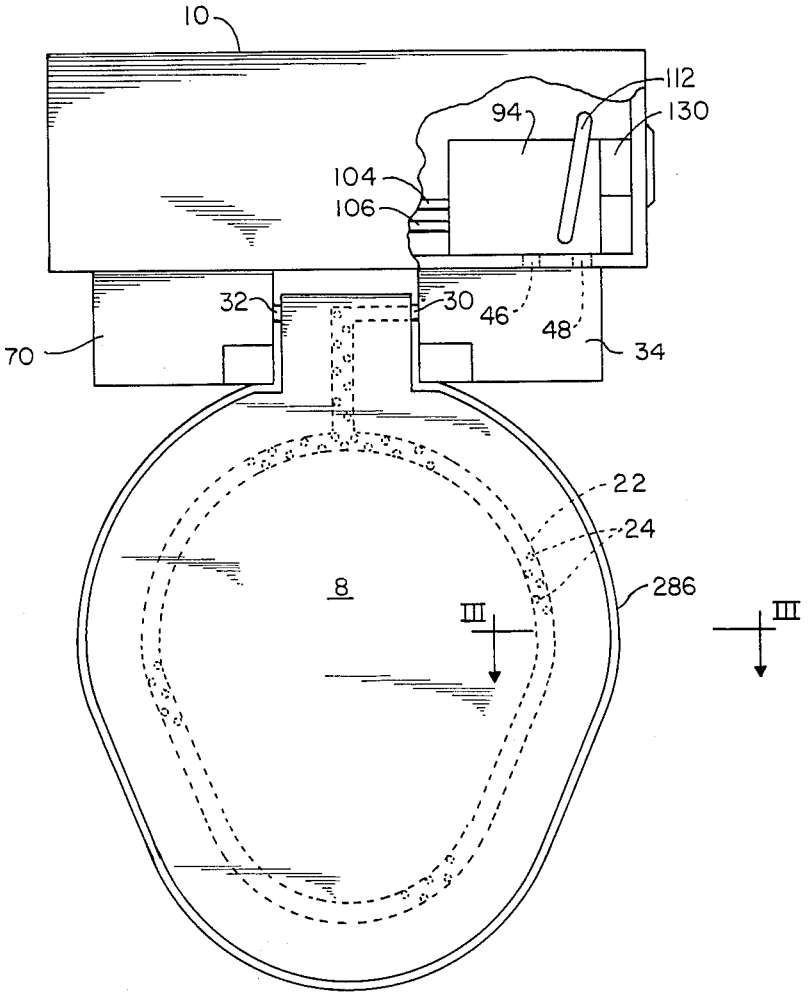
FIG. 1 is a top plan view, partly broken away, of one form of toilet apparatus illustrative of an embodiment of the invention; the interior channel and holes of the cover member are shown in phantom.
Figure 2:
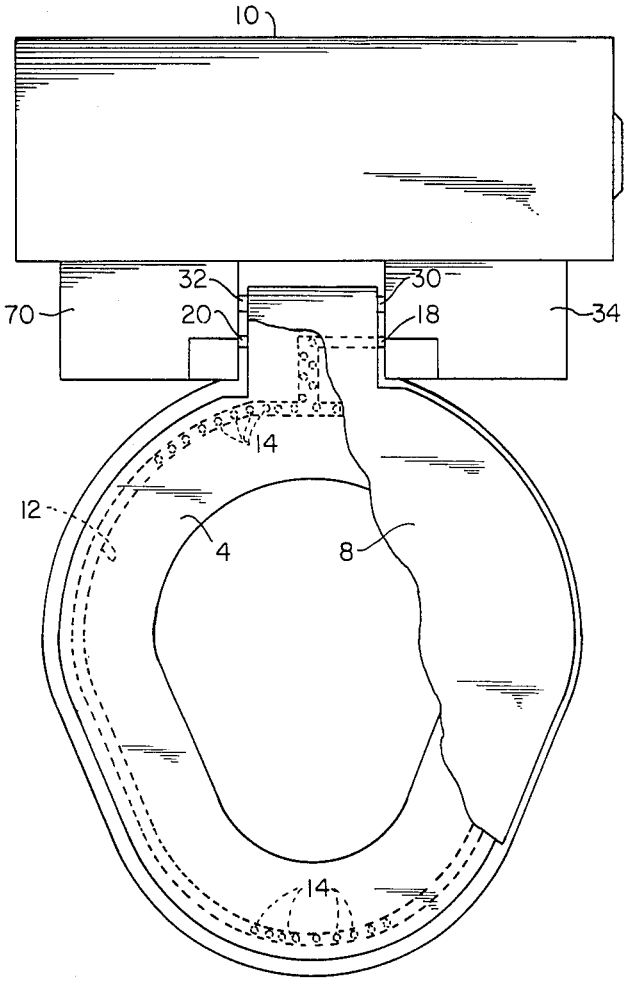
FIG. 2 is a top plan view, similar to FIG. 1, but with the cover member broken away, and showing the interior channel and holes of the seat member in phantom.
Figure 3:
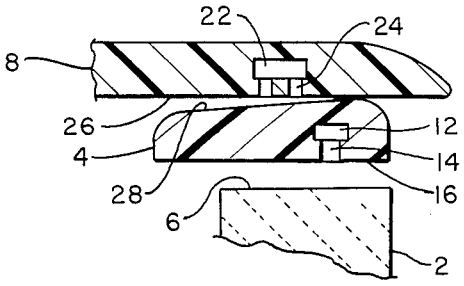
FIG. 3 is an enlarged sectional view, taken along line III—III of FIG. 1, and omitting a rim sealer portion.

Referring to the drawings, particularly FIGS. 1–5, it will be seen that the toilet apparatus of the present invention includes a bowl portion 2 (FIGS. 3–5), a seat member 4 (FIGS. 2–4) pivotally mounted and adapted to overlie a rim portion 6 (FIG. 3) of the bowl portion 2, a cover member 8 pivotally mounted and adapted to overlie upper surface portions of the seat member 4, and a holding tank 10 adapted to retain water and/or other liquids for use in flushing the bowl after use.

The toilet seat member 4 is provided with an interior channel 12 and a plurality of holes 14 (FIGS. 2 and 3) interconnecting the channel 12 and an undersurface 16 (FIG. 3) of the seat portion overlying the bowl rim portion 6. The channel 12 is in communication with a pipe 18 (FIG. 2), which is in alignment with a pivot mounting member 20 for the seat member 4. The pipe 18 and the pivot mounting member 20 are fixed to the seat member 4, and move with the seat portion, the pipe 18 and mounting member 20 rotating about their axes.

In like manner, the cover member 8 is provided with an interior channel 22 and a plurality of holes 24 (FIGS. 1 and 3) interconnecting the channel 22 and an undersurface 26 (FIG. 3) of the cover member overlying seat portion upper surfaces 28. The channel 22 is in communication with a pipe 30 (FIG. 1), which is in alignment with a pivot mounting member 32 for the cover member 8. The pipe 30 and the pivot mounting member 32 are fixed to the cover member 8, and move with the cover member, the pipe 30 and mounting member 32 rotating about their axes.

The pipes 18, 30 extend into a first housing 34 (FIGS. 6–9). Mounted on the pipe 30 is a spindle 36 and a rotary gear 38. The pipes 18, 30 are rotatably connected, respectively, to stationary pipes 40, 42, which are joined by a connection 44 to a conduit 46 (FIG. 6) which extends rearwardly out of the first housing. The stationary pipes 40, 42 are further joined in the first housing to form an additional single conduit 48 which extends rearwardly out of the first housing, generally parallel to the conduit 46.

Figure 6:
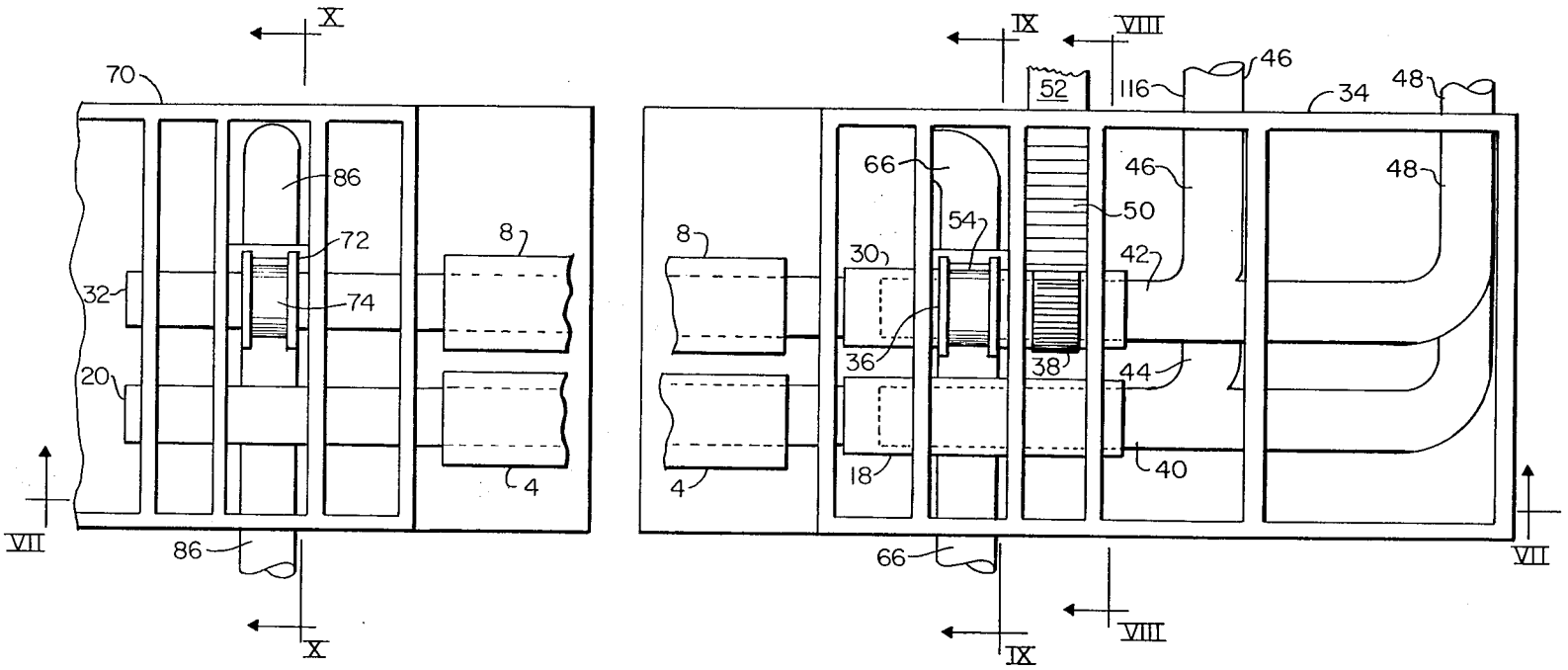
FIG. 6 is a top plan view of first and second housings on which are mounted the seat and cover members.
Figure 7:
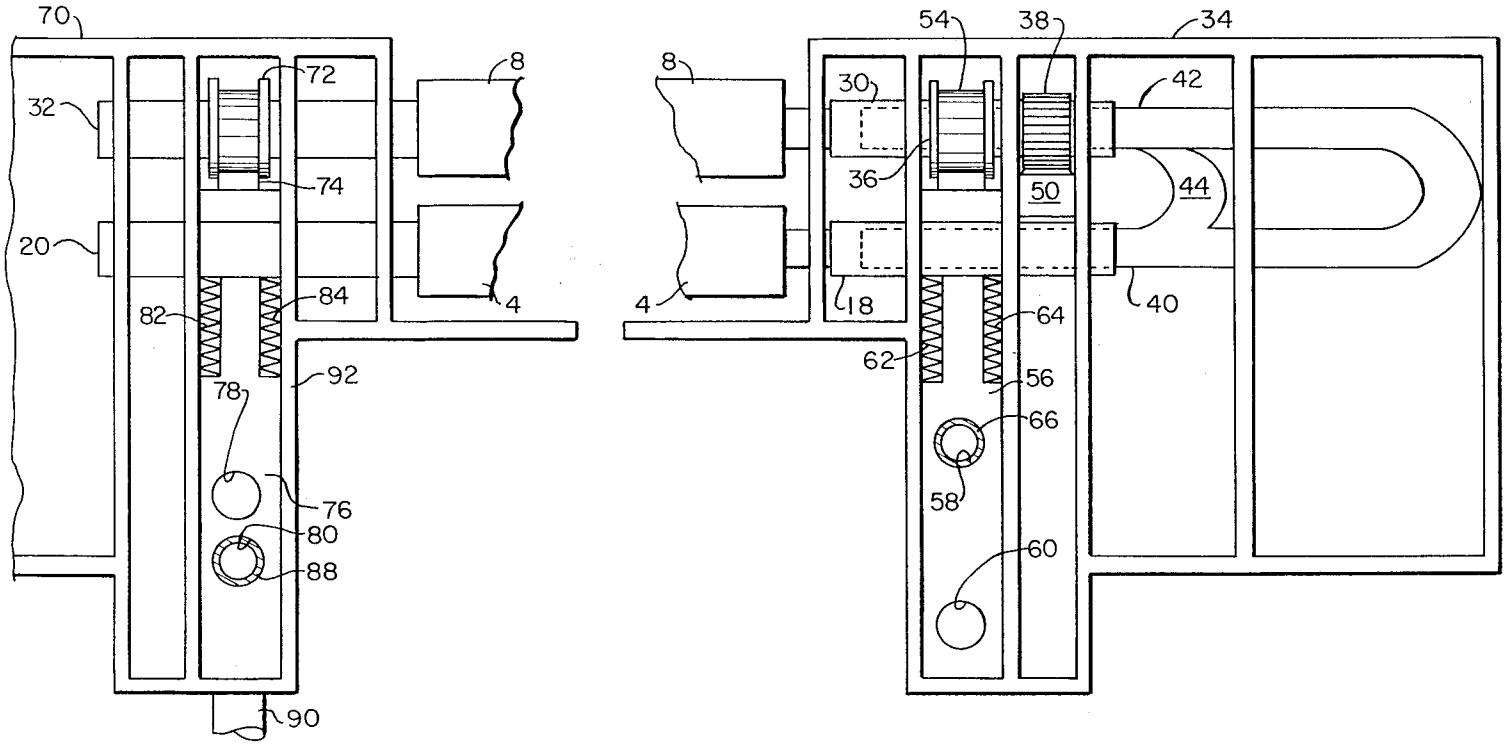
FIG. 7 is a sectional view, taken along line VII—VII of FIG. 6.
Figure 8:
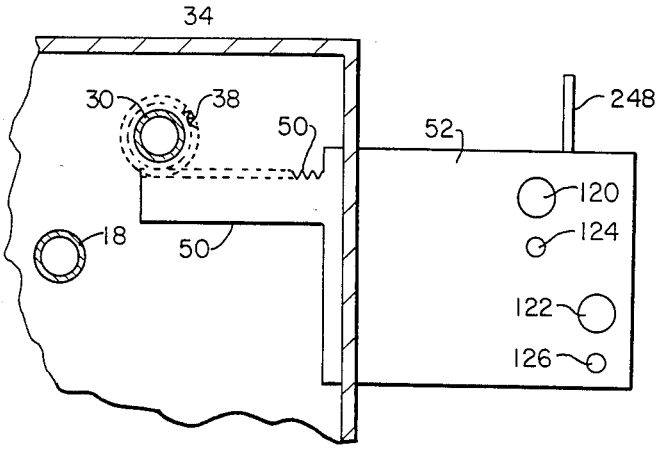
FIG. 8 is a fragmentary sectional view, taken along line VIII—VIII of FIG. 6.
Figure 9:
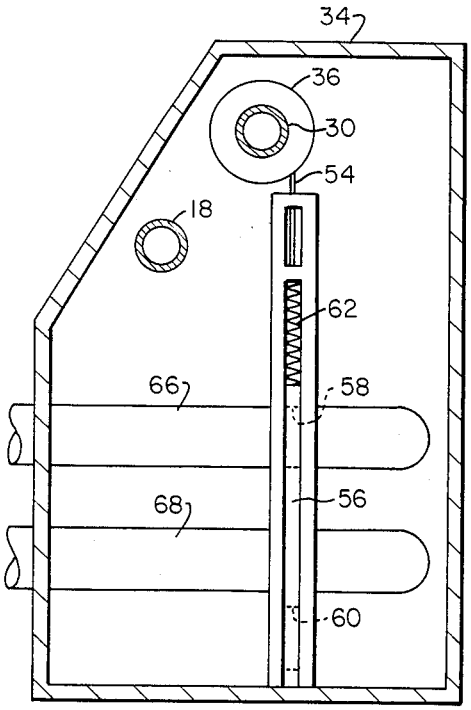
FIG. 9 is a sectional view taken along line IX—IX of FIG. 6.

The rotary gear 38 fixed to the pipe 30 is engaged with a gear track 50 extending from a slide member 52 which extends rearwardly and outwardly from the first housing 34 (FIGS. 6 and 8). Thus, pivotal movement of the cover member 8 causes rotary movement of the pipe 30 and thereby rotary movement of the gear 38, which in turn causes lateral movement of the gear track 50 and the slide member 52. Pivotal movement of the cover member 8 from a closed to an open position causes the slide member 52 to move forwardly (leftwardly as viewed in FIG. 8).

Movement of the pipe 30 also causes rotary movement of the spindle 36 mounted thereon. Coiled on the spindle 36 is a connector 54 attached at its remote end to a slide member 56 having therein first and second holes 58, 60. A pair of coil springs 62, 64 urge the slide member 56 downwardly. When the slide member 56 is in its downward-most position (FIGS. 7 and 9), the upper hole 58 of the two holes 58, 60 is in alignment with a first tubular member 66 and the lower hole 60 of the two holes is displaced from a second tubular member 68. Movement of the cover member 8 to a closed position, for example, rotates the spindle 36 in a counterclockwise fashion, when viewed as in FIG. 9, reeling in the connector 54 and raising the slide member 56 against the bias of the coil springs 62, 64. In the uppermost position of the slide member 56 (not illustrated), the upper hole 58 is removed from alignment with the first tubular member 66, shutting off the member 66, while the lower hole 60 is in alignment with the second tubular member 68, to maintain an open passageway through the second tubular member 68, for purposes to be described herein below.

The apparatus includes a second housing 70 (FIGS. 6, 7 and 10) which receives and serves as mounting means for the pivot mounting members 20, 32. The cover member pivot mounting member 32 has fixed thereon a spindle 72 having coiled thereon a connector 74. A remote end of the connector 74 is attached to a slide member 76 having therein an upper hole 78 and a lower hole 80. A pair of coil springs 82, 84 bias the slide member 76 toward a downward-most position. First and second tubes 86, 88 (FIG. 10) are mounted in the second housing and merge to form a single conduit 90 which enters the second housing from a source in the holding tank 10. The tubes 86, 88 are fixed to a slide member housing 92 in such a manner that the slide member is adapted to block passage of fluid through the tubes 86, 88, or, if a tube is in alignment with one of the holes 78, 80, to permit passage of the fluid through the open tube. For example, movement of the cover member 8 to an open position rotates the spindle 72 so as to reel out the connector 74 and permit the coiled springs 82, 84 to urge the slide member 76 to the downward-most position (FIGS. 7 and 10), such that the first tube 86 is blocked by the slide member 76, the upper hole 78 being removed from the first tube 86, and to permit flow through the second tube 88, the lower hole 80 being in alignment with the second tube 88, to permit flow therethrough.

Mounted in the holding tank 10, immediately behind the first housing 34 is a control unit housing 94 (FIGS. 1 and 11–15). The slide member 52, extending from the ratchet arm 50 in the first housing 34 (FIG. 8) is slidingly disposed in a slide valve housing 96 in the control unit housing 94.

Figure 4:
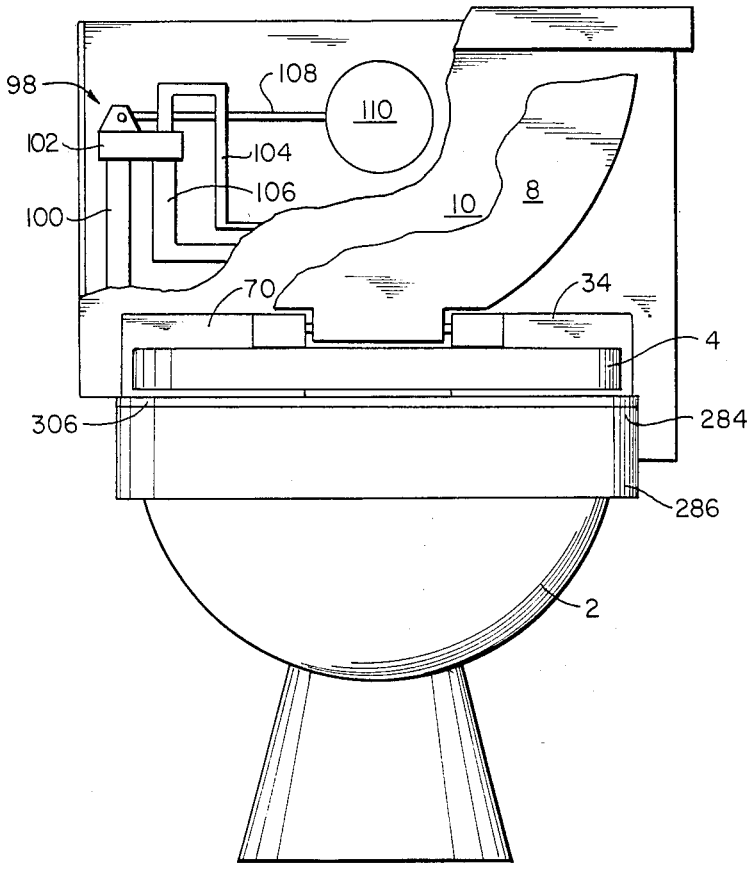
FIG. 4 is a front elevational view of the apparatus, partly broken away, shown with the cover member raised and the rim sealer retracted.
Figure 5:
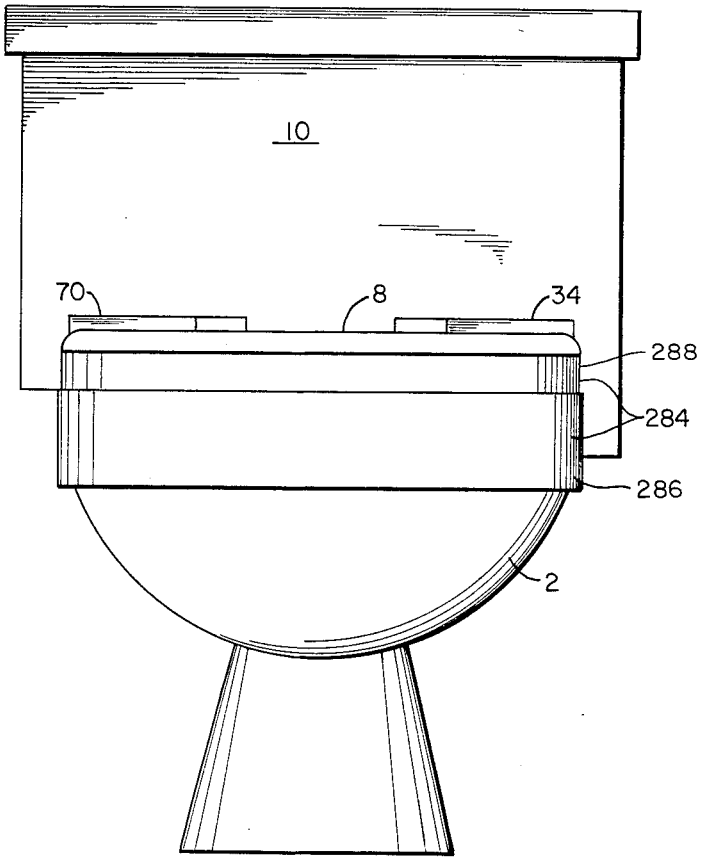
FIG. 5 is a front elevational view, similar to FIG. 4, but showing the cover member closed and the rim sealer raised into sealing position.

Also mounted in the holding tank 10 is the usual ball cock assembly 98 (FIG. 4). A pipe 100 brings water in from an external source, typically the water system of a house or building, into a manifold 102 from which extend two conduits, a smaller conduit 104 which in current toilet assemblies is normally used to refill the bowl, and a larger conduit 106 which is of the type generally used to refill the holding tank. The manifold is operated by a pivotally mounted lever 108 having a flotation body 110 on the distal end thereof. The aforementioned conduit 90 may be connected to the pipe 100 in the holding tank 10.

Figure 11:
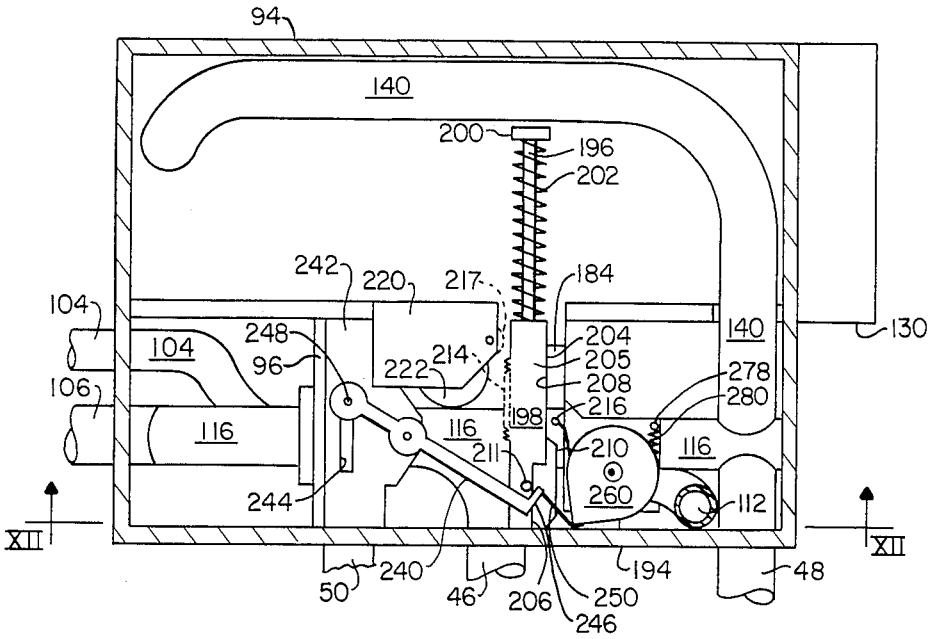
FIG. 11 is a top plan view, with parts broken away, of a control unit assembly.
Figure 12:
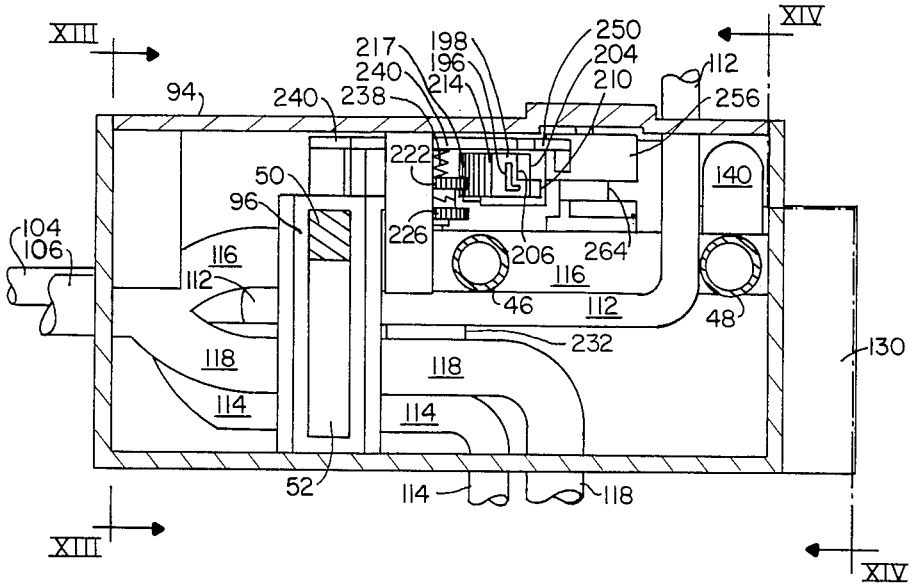
FIG. 12 is a sectional view of the control unit, taken along line XII—XII of FIG. 11.
Figure 13:
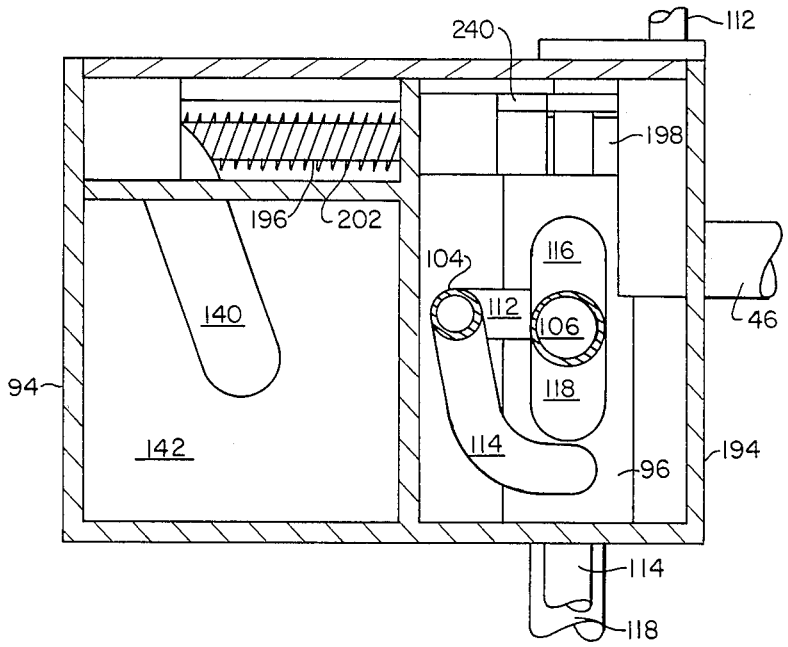
FIGS. 13 and 14 are sectional views of the control unit, taken along lines XIII—XIII and XIV—XIV of FIG. 12, respectively.
Figure 14:
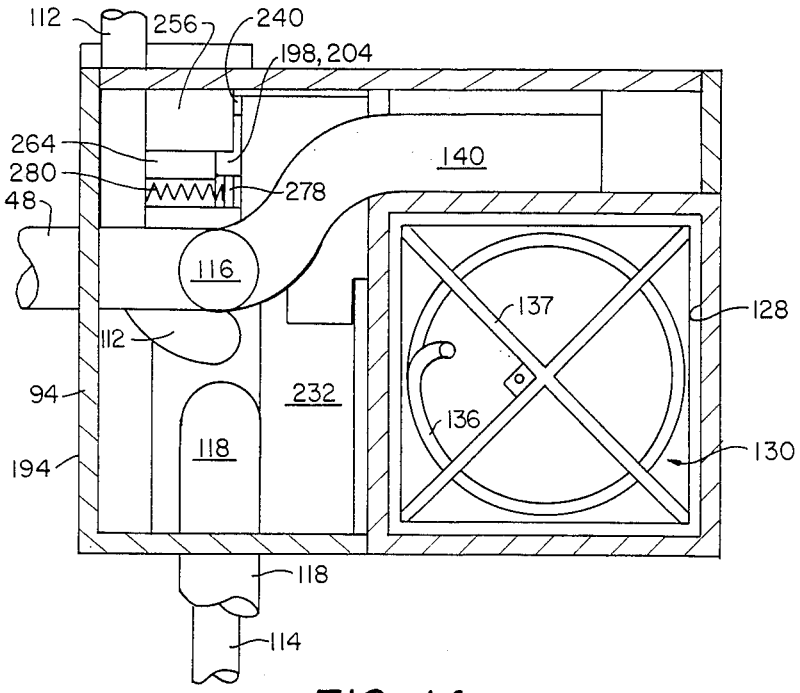
Figure 15:
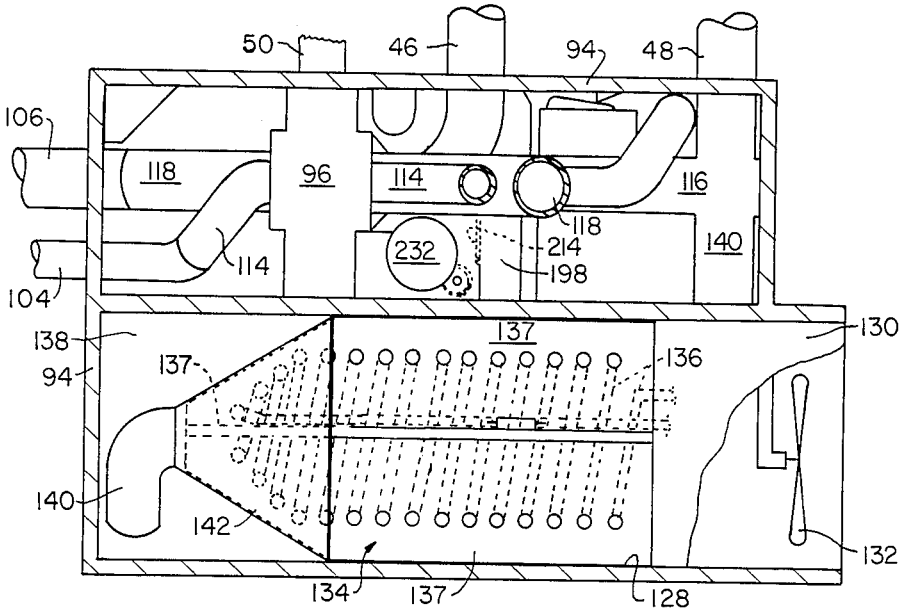
FIG. 15 is a bottom view, with parts broken away, of the control unit.

The small conduit 104 and large conduit 106 enter the above-referred-to control unit housing 94 (FIGS. 1, 11 and 15). Inside the housing 94, the small conduit 104 bifurcates into conduits 112 and 114, and the large conduit 106 bifurcates into conduits 116 and 118. The four conduits 112, 114, 116 and 118 are interrupted by the slide valve housing 96 (FIG. 12). The slide member 52 (FIG. 8) has four apertures 120, 122, 124, 126 therein, the apertures 120 and 122 being larger, and the apertures 124 and 126 being smaller, the larger apertures 120, 122 being located so as to be aligned with the larger conduits 116, 118 and the smaller apertures 124, 126 being adapted to be aligned with the smaller conduits 112, 114. The position of the slide member 52 determines which pair of the four conduits 112, 114, 116, 118 will be open at a given time. When the toilet cover member 8 is in the closed position, for example, the slide member is extended rearwardly of the first housing 34 to position the upper pair of apertures 120, 124 in alignment with the conduits 116, 112, respectively, with the lower apertures 122, 126 removed from alignment with the conduits 118, 114, respectively. The raising, or opening, of the cover member 8 moves the slide member 52 in the slide valve housing 96 so as to position the lower apertures 122, 126 in alignment with the conduits 118, 114, respectively, with the upper apertures 120, 124 removed from the conduits 116, 112. Conduit 114 refills the bowl portion 2 and conduit 118 refills the holding tank 10. Accordingly, when the cover member 8 is raised, the water is used to refill the tank and bowl, as in a normal toilet apparatus. But when the cover member 8 is in the closed position, the water is used to refill the tank 10 and clean the seat member 4 and bowl rim portion 6 by way of the conduits 112 and 116, respectively, as will be further described herein below.

After a flushing operation, whether the cover member 8 is open or closed, the holding tank 10 will be refilled by the pipe 100 through the manifold 102. Incoming flow of water will continue until the holding tank is refilled and the flotation body 110 has caused closure of the ball cock assembly 98.

The control unit housing 94 includes a compartment 128 (FIGS. 14 and 15) in the lower and rearward portion thereof which includes an air inlet section 130, having mounted therein an air intake fan 132, an air heating section 134, having mounted therein electrical heating coils 136, on struts 137, and an outlet section 138. An air tube 140 is connected to an outlet funnel 142 in the outlet section 138. The air tube 140 extends substantially the length of the control unit back toward the air inlet section 130 (FIG. 11) and joins the conduit 116 and thereafter exits the control unit housing 94 as the conduit 48.

Figure 16:
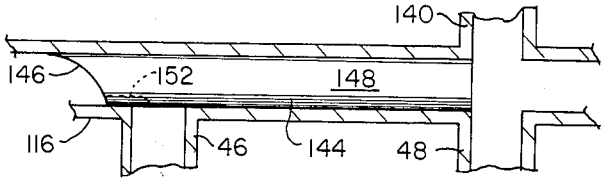
FIG. 16 is a diagrammatic representation of a valve portion taken from FIG. 12, the valve being shown in a selected position.
Figure 17:
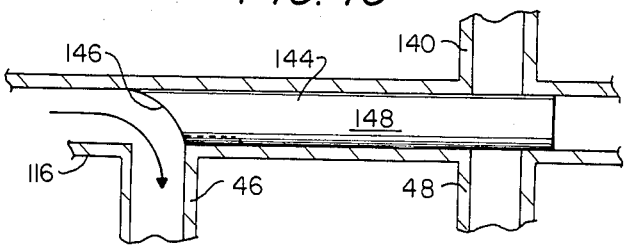
FIG. 17 is similar to FIG. 16, but shows the illustrative valve in an alternative position.

In the conduit 116, between the conduits 46 and 48 (refer to FIGS. 12, 16 and 17), there is disposed a trigger valve 144. Water flowing through the conduits 106, 116 (FIG. 12) will bear against a curved end surface 146 (FIGS. 16 and 17) of a plunger 148 slidably disposed in the conduit 116. The flow of water against the curved end surface 146 of the plunger 148 urges the plunger 148 to the rightward position, as shown in FIG. 17, blocking the air tube 140 so as to prevent the flow of air therethrough and prevent the entry of water into a heating coil and fan section, to be described below, but opening the conduit 46 so as to permit the flow of water therethrough. When the flow of water through the system has been stopped by the ball cock assembly 98, pressure on the curved surface 146 drops, and a coil spring 150 (shown in FIG. 18A) moves the plunger leftwardly, as viewed in FIG. 16, to close the conduit 46 and open the air tube 140 - conduit 48 passage to the flow of air therethrough. The curved end surface 146 of the plunger 148 is provided with a small groove 152 (FIG. 16) which allows any water trapped in the conduit 116 to drain and also prevents any pressure build up in the conduit 116 which might prevent or delay the valve's closing.

Figure 18:
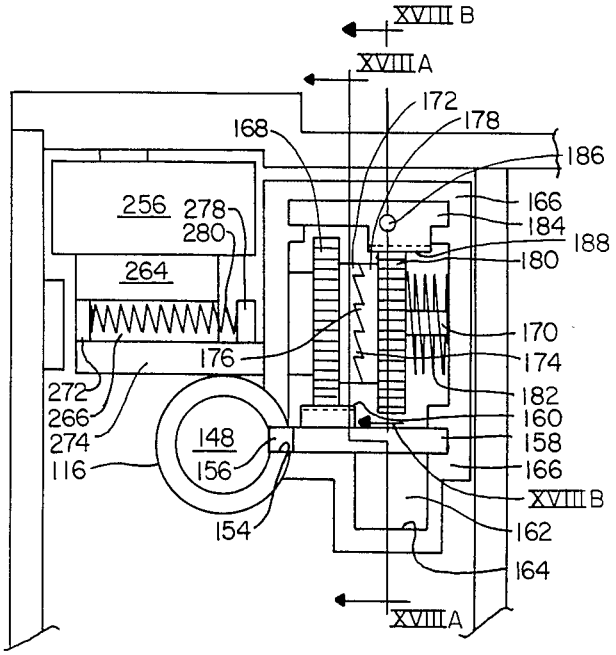
FIG. 18 is a side elevational view of the valve of FIG. 12, with associated apparatus and of a trigger mechanism.
Figure 18A:
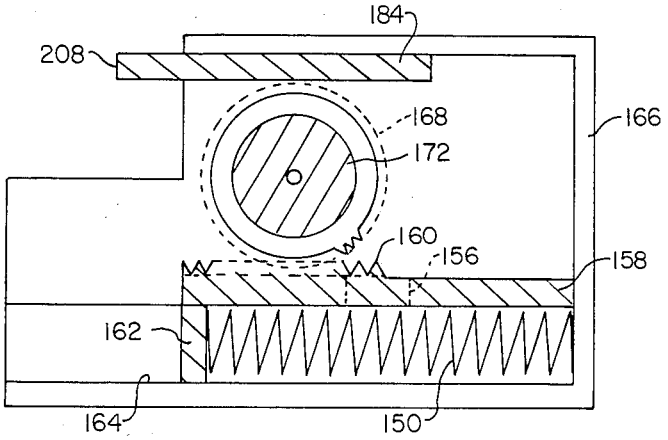
FIG. 18A is a sectional view taken along line XVIIIA—XVIIIA of FIG. 18.
Figure 19A:
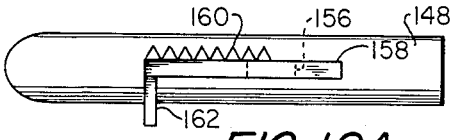
FIGS. 19A–19D show, respectively, top, bottom, side and end views of a plunger portion of the valve shown in FIGS. 16–18.
Figure 19B:
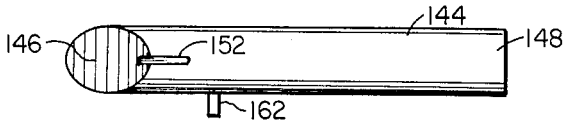
Figure 19C:
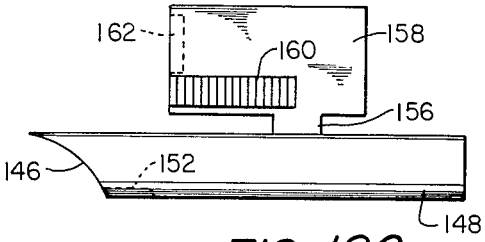
Figure 19D:
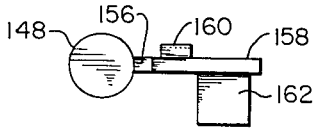

The conduit 116, between the conduits 46 and 48, is provided with a slot 154 (FIG. 18) on the rearward side thereof through which extends a protrusion 156 (FIGS. 18, 19C) from the plunger 148, the protrusion having at its outer end an enlarged planar member 158 with a gear track 160 on a portion of one surface thereof. Depending from the planar member 158 is a lug 162 (FIGS. 18, 18A, 19D) against which bears the coil spring 150 (FIG. 18A). The lug 162 and the spring 150 are disposed in a trough 164 formed in a sub-housing 166 (FIGS. 18, 18A). Thus, movement of the plunger 148 causes like movement of the planar member 158 and the gear track 160. A rotary gear 168 is engaged with the gear track 160 and is caused to rotate by lateral movement of the gear track. The rotary gear 168 is mounted on a rod 170 (FIG. 18) which is mounted in the sub-housing 166. Fixed to the gear 168 is a first annular one-way ratchet 172, the teeth 174 of which are complementary to and engageable with teeth 176 (FIG. 18) of a second annular ratchet 178 fixed to a face of a rotary gear 180 mounted on the rod 170 opposed to the first annular ratchet 172. Also mounted on the rod 170 is a spring member 182 which urges the second annular ratchet 178 into engagement with the first annular ratchet 172. Thus, movement of the plunger 148 carries with it movement of the protrusion 156 and the planar member 158, on which is disposed the gear track 160. Longitudinal movement of the gear track 160, which is engaged with the rotary gear 168, causes the gear 168 to rotate on the rod 170. If rotated in a first direction, the gear 168 will have no effect upon the rotary gear 180; however, if rotated in a second direction, because of the one-way arrangement of the annular ratchets 172, 178, will transmit the rotative movement to the gear 180.

Figure 18B:
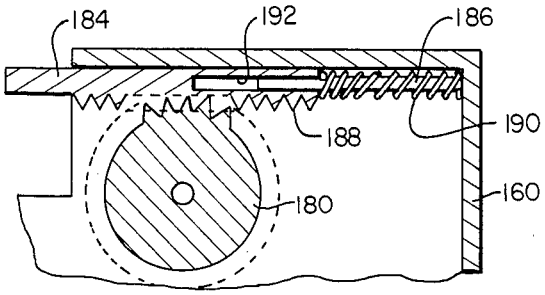
FIG. 18B is a sectional view taken along line XVIIIB—XVIIIB of FIG. 18.

Mounted over the above-described trigger valve and gear arrangement is a locking member 184 (FIGS. 11, 18, 18A) mounted on a rod 186 (FIGS. 18, 18B) extending from the sub-housing 166 substantially parallel to and above the trough 164 retaining the coil spring 150. On an undersurface of the locking member 184 there is disposed a gear track 188 in threaded engagement with the rotary gear 180. A coil spring 190 (FIG. 18B) is mounted on the rod 186 and is disposed between a wall of the sub-hosing 166 and the locking member 184. The locking member 184 is provided with a hole 192 (FIG. 18B) therein which receives an end of the rod 186. Accordingly, rotative movement of the rotary gear 168 may cause rotary movement of the gear 180, which causes longitudinal movement of the locking member 184, against the bias of the coil spring 190.

Figure 20A:
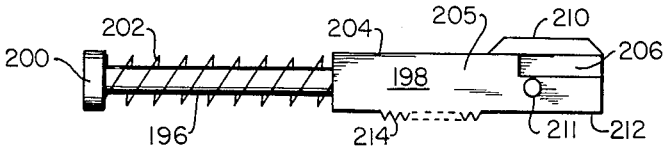
FIGS. 20A–20D show top, first side, bottom, and second side views, respectively, of a timer portion of the control unit.
Figure 20B:
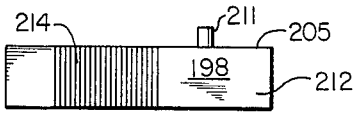
Figure 20C:
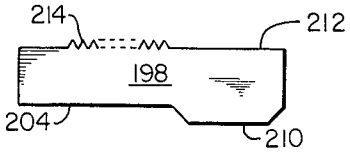
Figure 20D:
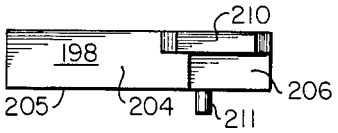

Mounted on an internal surface of a forward wall 194 of the control unit housing 94 is a timer track 196 (FIGS. 11, 12, 20A), which comprises a rigid elongated rod. Slidably mounted on the timer track 196 is a timer bar 198 (see also, FIGS. 20B–20D). Fixed to a free end of the timer bar 196 is a timer end mount 200. Disposed on the timer track 196, between the end mount 200 and the timer bar 198, is a coil spring 202. On a first side 204 and top 205 of the timer bar 198, there is an elongated recess 206 (FIGS. 20A and 20D) adapted to receive an end 208 of the locking member 184 (FIG. 18A). When the locking member 184 is engaged with the recess 206 of the timer bar 198, the timer bar is stopped from movement on the timer track.

On the timer bar first side 204 there is disposed a raised portion 210 and on a second side 212 of the timer bar 198 there is disposed a gear track 214.

When the locking member 184 is withdrawn from the timer bar recess 206, the timer bar 198 is urged forwardly on the timer track 196 by the coil spring 202, causing the timer bar to slidingly move toward the wall 194. In the movement of the timer bar 198, the raised portion 210 encounters an arm 216 (FIGS. 11 and 22) of a microswitch at the same time as the gear track 214 engages a rotary gear 217 (FIGS. 11 and 21).

Figure 21:
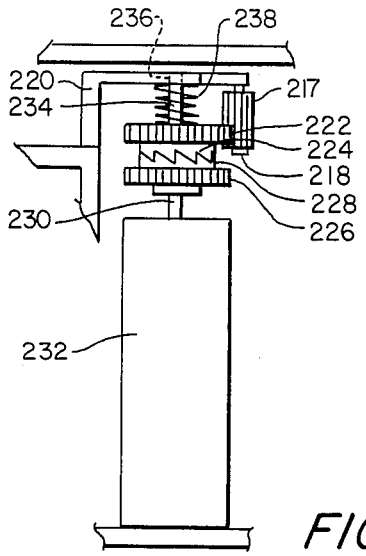
FIG. 21 is an elevational view of a motor assembly portion of the control unit.
Figure 28:
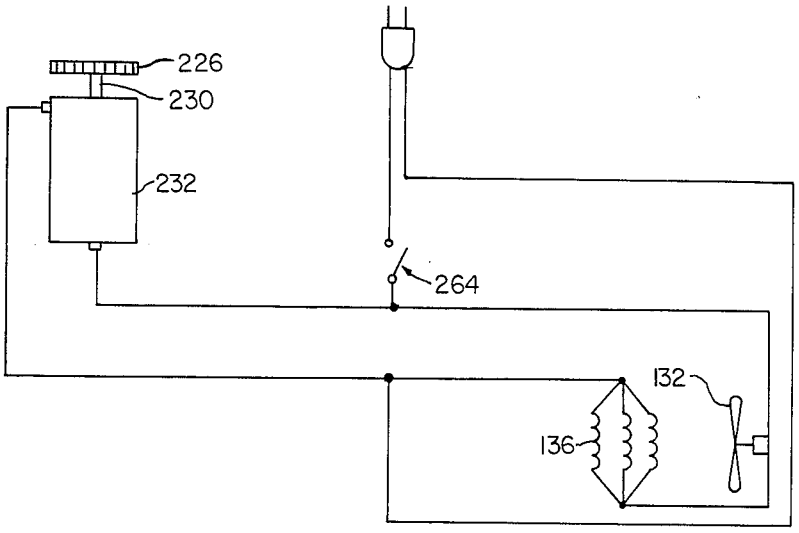
FIG. 28 is a diagrammatic representation of the electrical circuit of the apparatus.

The rotary gear 217 is mounted on a pin 218 depending from a bracket member 220 (FIG. 21). Disposed adjacent the gear 217 and in engagement therewith is a rotary gear 222 having an annular one-way ratchet track 224 on an undersurface thereof. In opposition to the rotary gear 222 there is disposed a rotary gear 226 having an annular one-way ratchet track 228 on an upper surface thereof. The rotary gears 222, 226 are mounted on a rod 230 which extends from an electrical motor 232 and is received at its free end 234 in a hole 236 in the bracket member 220. The gear 222 is free to rotate on the rod 230, but the gear 226 is fixed to the rod 230. Mounted on the rod 230, between the bracket member 220, and the gear 222 is a coil spring 238 urging the ratchet track 224 into engagement with the ratchet track 228. Rotation of the gear 217 by the timer bar gear track 214 is transmitted through the ratchet tracks 224, 228 to the rod 230, which is an extension of the core of the motor 232. As noted above, at about the same time as the gear track 214 engages the rotary gear 218, the raised portion 210 of the timer bar 198 engages a microswitch arm 216, which through an associated electrical circuit (FIG. 28) conducts current to the motor 232, the fan 132, and the heating coils 136 to initiate the flow of warm air through the air tube 48 for the purpose of drying the bowl rim and seat surfaces, as will be further described below. The speed of the motor 232 regulates the speed of movement of the timer bar 198 through the gears 214, 217, 222, 224 and 228.

When the spring 202 has urged the timer bar 198 to a further point along the timer rod 196 at a speed dictated by the motor 232, the raised portion 210 will depart the microswitch arm 216 and, substantially simultaneously, the gear track 214 will disengage from the rotary gear 217, shutting down the flow of electricity to the motor 232 and to the electrical circuit of the fan and heating coils. The disengagement of the gear track 214 and rotary gear 217 allows the timer bar to be moved by the coil spring 202 into its extended position.

To summarize the blow-dryer operation briefly, when the holding tank has refilled, and flow of water through the system has stopped, the coil spring 150 urges the plunger 148 to a position in which the conduit 46, for water, is closed and the conduit 48, for air, is open, as described above. Movement of the plunger 148 is accompanied by similar movement of the gear track 160 and rotary movement of the gear 168, which in turn rotates the gear 180. Rotation of the gear 180 moves the locking member 184 against the bias of the spring 190 to release the timer bar 198. Under the influence of the spring 202, the timer bar gear 214 engages the rotary gear 217 operable by the motor 232, and engages the microswitch arm 216 to energize an electrical circuit which in turn energizes the motor 232 and the blower section of the apparatus, i.e., the fan 132 and heating coils 136, to generate the flow of air through the air tube 48 to purge the system of water and to dry the just-cleansed surfaces.

The timer bar 198 is cocked by the movement of the slide member 52. Mounted above the slide valve housing 96 is a swing bar 240 pivotally connected to a base plate 242 having therein an elongated slot 244 extending in the direction of movement of the slide member 52 (FIG. 11). At the distal end of the swing bar 240 there is an extension 246 adapted to engage a detent 211 upstanding from the top 205 of the timer bar 198. At the base end of the swing bar 240 there is a depending pin 248 disposed in the slot 244 and connected to the slide member 52. Thus, in movement of the slide member 52 forwardly towards the first housing, as when the cover member 8 is opened, the slide member carries the pin 248, moving the base end of the swing bar 240 forwardly and pivoting the free end of the spring bar rearwardly, the extension 246 pushing rearwardly against the detent 211 to move the timer bar against the bias of the spring 202. When the timer bar reaches the cocked position, the locking member 184 snaps into the recess 206 under bias of the spring 190.

It will be apparent that when the timer bar is in its extended position, the raised portion 210 of the timer bar 198 is removed from the microswitch arm 216. To prevent tripping of the microswitch arm 216, and the consequent operation of the blow dryer apparatus and the motor when the timer bar is moved from its extended position to its cocked position, there is provided means for removing the microswitch arm 216 from the path of the timer bar raised portion 210. The distal end of the swing bar 240 is attached to a connector 250 (FIGS. 11, 22, 22A) in the form of a flexible metal tape which is fed from a reel 252 and which, within the reel 252, is attached to a coil leaf spring 254. The reel 252 is disposed in a case 256 having a pin 258 upstanding from a lid portion 260 thereof. The control unit lid is provided with a recess 262 for receiving the pin 258. Fixed to the bottom of the case 256 is a microswitch 264 actuated by the aforementioned microswitch arm 216. Fixed to the bottom of the microswitch 264 is a swivel plate 266 (FIGS. 18, 22, 22B) having therein a centrally disposed hole 268 and a corner recess 270, and having extending therefrom an arm 272.

A bracket member 274 attached to the sub-housing 166 has upstanding therefrom a center pin 276 upon which is pivotally fitted the swivel plate 266 by way of the swivel plate hole 268. Also upstanding from the bracket member 274 is a spring pin 278 to which is attached a first end of a coil spring 280. A second end of the coil spring 280 is attached to the arm 272. A stop pin 282 further upstands from the bracket member 274 and is adapted to engage the corner recess 270 in the swivel plate 266 to limit the pivotal movement of the swivel plate, microswitch and reel.

As noted above, when the distal end of the swing bar 240 moves rearwardly as by raising the cover member 8, it pulls upon the connector 250 and rotates the swivel plate 266 upon the pins 258, 276, which moves the microswitch arm 216 out of the path of engagement with the timer bar. The swivel plate 266 rotates until the corner recess 270 of the swivel plate engages the stop pin 282. When the swivel plate comes to a stop against the pin 282, the connector continues to unreel, permitting the swivel bar to continue its rearward movement to cock the timer bar. When the cover member 8 is moved to the closed position, the slide member 52 is moved rearwardly and the swing bar 240 is pivotally moved so that the base end thereof is disposed rearwardly in the slot 244 and the distal end is disposed forwardly, permitting the connector 250 to be taken up by the reel 252. After the connector 250 has been taken up by the reel 252, the spring 280 rotates the reel and switch assembly, mounted on the swivel plate 266, back to a position in which the microswitch arm 216 is aligned with the raised portion 210 of the timer bar 198.

In the return of the timer bar 198 to its cocked position, the timer bar gear track 214 rotates the gear 217. However, in this instance the gear 217 turns the gear 222 in a direction in which the one-way annular ratchet tracks 224, 228 do not threadedly engage, so that the motor 232 remains undisturbed. Thus, return of the timer bar to its cocked position neither engages the motor 232 nor activites the microswitch 264.

In a cleaning operation, water is sprayed from the holes 14, 24 onto the upper surfaces of the bowl rim 6 and seat member 4, respectively. To insure that such water is drained into the bowl, and not allowed to trickle down the outside of the bowl, there is provided a rim sealer assembly 284 mounted on the bowl portion 2 of the assembly.

Figure 22:
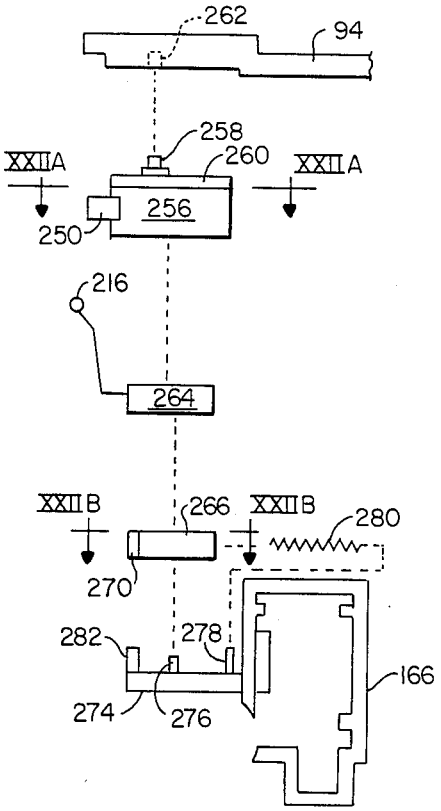
FIG. 22 is an exploded view of a switch and reel assembly portion of the control unit shown in FIG. 18.
Figure 22A:
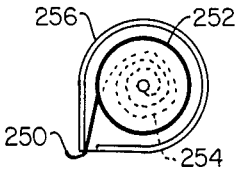
FIG. 22A is a sectional view taken along line XXIIA—XXIIA of FIG. 22.
Figure 22B:
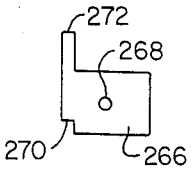
FIG. 22B is a view taken along line XXIIB—XXIIB of FIG. 22.
Figure 23:
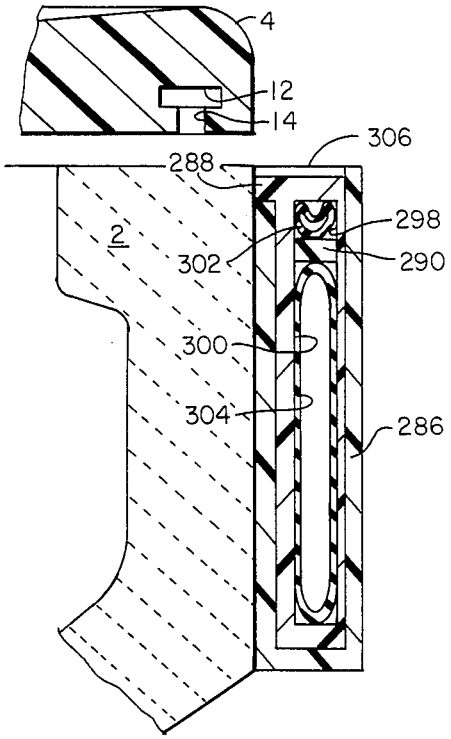
FIG. 23 is a sectional view similar to FIG. 3, but showing a rim sealer means in a retracted position, and assuming the seat cover is in the raised position.
Figure 26:
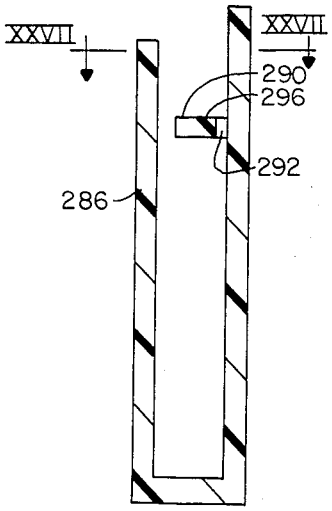
FIG. 26 is a sectional view of the rim sealer housing alone.
Figure 27:
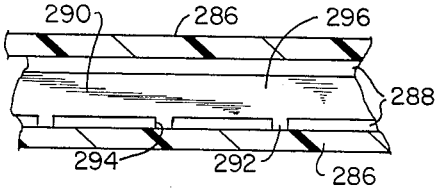
FIG. 27 is a sectional view, taken along line XXVII—XXVII of a portion of the rim sealer apparatus.

The rim sealer assembly 284 (FIGS. 23–27) includes a housing 286 shaped complementary to the bowl 2 and having disposed therein a slide member 288. The housing has mounted on the interior thereof a tube support shelf 290 which is attached to an interior wall of the housing 288 by a series of legs 292 (FIGS. 26 and 27). The slide member 288 is provided with elongated slots 294 through which extend the legs 292, with a principal portion 296 of the shelf 290 being disposed within the slide member 288, dividing the interior of the slide member 288 into an upper chamber 298 and a lower chamber 300 (FIGS. 22 and 23). An upper tube 302 is disposed in the upper chamber 298 and is anchored to an upper surface of the shelf principal portion 296. In like manner, a lower tube 304 is disposed in the lower chamber 300 and is anchorded to an under surface of the shelf principal portion.

Figure 10:
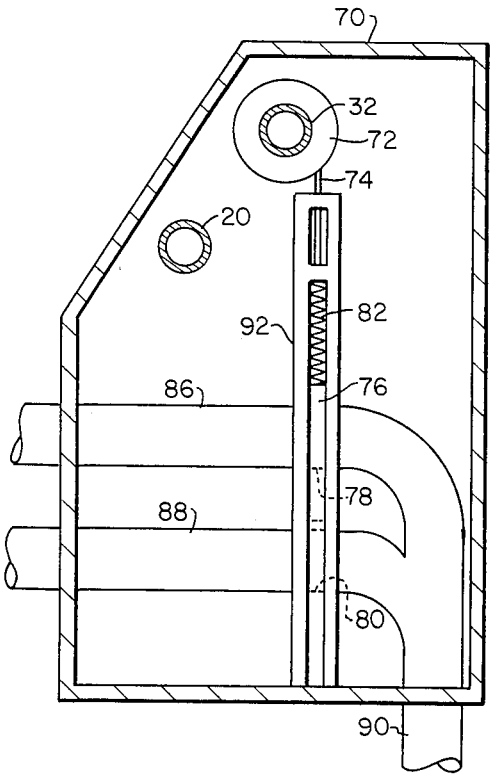
FIG. 10 is a sectional view taken along line X—X of FIG. 6.

The upper tube is in communication with the first tubular member 66 (FIGS. 6, 9 and 10) in the first housing 34 and the first tube 86 in the second housing, and the lower tube is in communication with the second tubular member 68 in the first housing and the second tube 88 in the second housing (FIG. 10).

Figure 24:
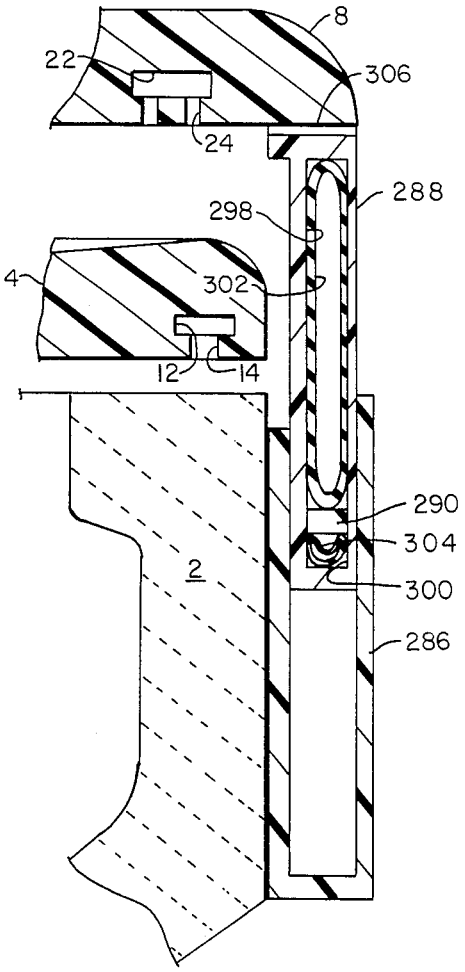
FIG. 24 is a sectional view similar to FIG. 23, but showing the rim sealer means in a raised position and in sealing engagement with the closed seat cover.
Figure 25:
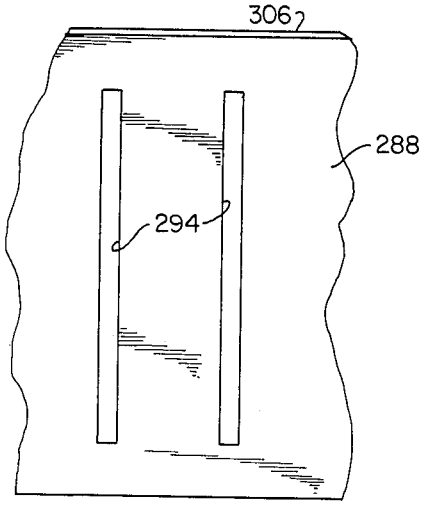
FIG. 25 is a partial side elevational view of a slide member portion of the rim sealer apparatus.

Referring again to the first housing 34, when the cover member 8 is closed, the slide member 56 is in its uppermost position, aligning the tubular member 68 with a hole 60 to drain the lower rim sealer tube 304. At the same time, in the second housing 70, when the cover member 8 is closed, the slide member 76 is moved to its uppermost position, such that the first tube 86 is aligned with the hole 78 in the slide member 76 to permit flow of water from an outside source, via the conduit 90, through the second tube 86 to the rim sealer upper tube 302, with which the second tube 86 is in communication, to inflate the upper tube 302. Inflation of the rim sealer upper tube and draining of the rim sealer lower tube 304, causes the slide member 288 to ride upwardly in the housing 286, until a rubber-like upper layer 306 on the upper end of the slide member engages the undersurface of the cover member 8 to effect a seal, as shown in FIG. 24 and generally in FIG. 5. Raising of the cover member 8 reverses the arrangement, such that the upper tube 302 is permitted to drain, the lower tube 304 is inflated, to move the slide member 288 downwardly into the housing 286 and out of the way, as shown in FIGS. 23 and 4.

The operation of the apparatus will now be described, starting with a condition in which the holding tank 10 is filled and the manifold 102 is closed, preventing flow in the bowl refill pipe, or small conduit 104, and in the tank refill pipe, or large conduit 106 (FIG. 4). The cover member 8 is in the raised position and the seat member 4 is in the down position.

With the cover member 8 in the raised position, the cover mounting pipe 30 has been positioned such that the slide member gear 38 has been rotated clockwise, as viewed in FIG. 8, to cause the slide member 52 to have been moved forwardly to have the apertures 122, 126 aligned, respectively, with the large conduit 118, which is the tank refill conduit, and the small conduit 114, which is the bowl refill conduit (FIG. 12).

With the slide member 52 disposed forwardly, the swing bar 240 (FIG. 11) has had its base end urged forwardly and its distal end urged rearwardly, having moved the timer bar 198 to its cocked position, where it is held by the locking member 184. The motor 232 is at rest.

The cover member 8 in the open position has also rotated the spindles 36, 72 (FIG. 7), which are fixed to the cover mounting pipes 30, 32, clockwise so as to reel out the connectors 54, 74 to permit the slide member 56, 76 to be urged into their lowermost positions by the springs 62, 64 and 82, 84. In their lower positions, the slide members 56, 76, respectively align the aperture 58 with the first tubular member 66 and the aperture 80 with the second tube 88. The tubular member 66 drains the rim sealer upper tube 302 and the tube 88 inflates the rim sealer lower tube 304, with water from the conduit 90 to place the rim sealer slide member 288 in its withdrawn, or retracted position (FIG. 23).

A flushing operation with the apparatus in the above-described condition, will cause water to flow through the bowl refill pipes 104, 114 and the tank refill pipes 106, 118 (FIG. 12), as in a normal toilet apparatus.

The closing of the cover member 8 rotates the cover mounting pipes 30, 32 to rotate the spindles 36, 72 counter-clockwise to raise the slide members 56, 76, reversing the aperture and tube alignments such that the rim sealer lower tube 304 drains into the second tubular member 68, and thence into the bowl position 2, and the rim sealer upper tube 302 is inflated to push the rim sealer slide member 288 upwardly until the rubber sealing layer 306 sealingly engages the undersurface of the cover member 8 (FIG. 24).

Movement of the cover mounting pipes 30, 32 also causes counter-clockwise rotation of the slide member gear 38 (FIG. 8) which is engaged with the slide member gear arm 50 and causes the slide member 52 to move rearwardly. Such rearward movement of the slide member 52 removes the slide member apertures 122, 126 from alignment with the conduits 114 and 118, and positions the apertures 120, 124 in alignment with the conduits 112 and 116, respectively, the conduit 112 leading into the holding tank for the purposes of refilling the tank, and the conduit 116 being adapted to be placed in communication with the cleaning channels 12, 22. Water in the cleaning conduit 116 is stopped at the trigger valve 144 (FIG. 16) where the plunger 148 is biased into a blocking position in the conduit 116 by the coil spring 150.

Upon actuation of a flush mechanism (not shown) the holding tank 10 empties into the bowl portion 2, causing the flotation body 110 (FIG. 4) to descend and open the manifold 102 to open communication between the water supply pipe 100 and the bowl refill pipe 104 and the tank refill pipe 106. The flow from the bowl refill pipe 104 divides into the tank refill conduit 112 and the bowl refill conduit 114 (FIG. 12). The flow from the tank refill pipe 106 divides into the cleaning conduit 116 and the tank refill conduit 118. As noted above, at the slide member 52, the conduits 114 and 118 are closed. Thus, flow continues only through the tank refill conduit 112 and the cleaning conduit 116. The tank refill conduit 112 operates to convey water from the water supply pipe 100 to the holding tank to refill the holding tank. Flow through the conduit 116 continues to the trigger valve (FIG. 16) where the pressure of the water flow overcomes the bias of the spring 150 to move the plunger 144 to the position shown in FIG. 17, which places the cleaning conduit 116 in communication with the cleaning conduit 46, which in turn, is in communication with the stationary pipes 40, 42. The stationary pipe 40 (FIG. 6) is connected to the seat mounting pipe 18 which conveys water to the seat channel 12 from whence, through the holes 14, water is sprayed onto the bowl rim upper surface 6. The stationary pipe 42 is connected to the cover mounting pipe 30 which conveys water to the cover member channel 22 from whence, through the holes 24, water is sprayed onto the seat upper surface 28.

In due course, the holding tank 10 is refilled by the tank refill conduit 112. The flotation body 110 rises with the water level in the holding tank, actuating the manifold 102 to close off flow of water from the supply pipe 100 to the small and large conduits 104, 106.

With the conduit 104 shut off at the manifold 102, flow through the tank refill conduit 112 is stopped, and with the conduit 106 shut off at the manifold 102, flow through the cleaning conduit 116 is shut off. The loss of pressure in the conduit 116 permits the spring 150 of the trigger valve 144 to push the plunger 148 to a position in which the conduit 116 is closed (FIG. 16) and the air tube 140 is open to the conduit 48. The drain groove 152 in the plunger 148 permits any remaining water in the conduit 116 to escape.

Movement of the plunger 148 carries with it movement of the planar member 158 (FIG. 18) and the gear track 160 thereon, with consequent rotation of the rotary. gear 168, which is transmitted via the annular ratchets 172, 178 to the rotary gear 180. Rotation of the rotary gear 180 moves the locking member 184, by engagement with the gear track 188, against the bias of the coil spring 190.

Withdrawal of the locking member 184 from the recess 206 in the timer bar 198, permits the timer bar to travel forwardly on the timer track 196 under the influence of the spring 202. As the timer bar moves forwardly, the gear track 214 thereon engages the gear 217 while simultaneously the raised portion 210 engages the switch arm 216. Engagement of the switch arm 216 activates the motor 232 which, through a gear train 226, 228, 224, 222 and 217, dictates the rate of movement of the timer bar. Meanwhile, actuation of the switch arm 216 closes the microswitch 264 which energizes the motor 232, the fan 132, and the heating coils 136. The fan forces air through the heating section 134, the funnel 142, and the air tube 140 (FIG. 15), through the trigger valve 144 and into the conduit 48 which, in the first housing 34, is connected to the stationary pipes 40, 42, which lead to the previously sprayed seat and bowl rim surfaces. The flow of air purges the cleaning system of water and also serves to dry the previously washed surfaces.

The blow drying operation continues until the timer bar gear track 214 leaves the rotary gear 217 and the microswitch is disengaged from the timer bar raised portion 210, which shuts down the motor 232 and operation of the fan and the heating coils. At this point the apparatus is again at rest.

Raising, or opening, of the cover member 8 causes the rim sealer slide member 288 to retract into the rim sealer housing 286, as described above. Such movement of the cover member also operates to move the slide member 52 forwardly, the slide member carrying forwardly with it the base portion of the swing bar 240 which pivots the swing bar such that the distal end thereof engages a detent 211 upstanding from the timer bar 198 and urges the timer bar rearwardly against the bias of the spring 202. The forward movement of the slide member 52 also serves to again halt the flow of water through the conduit 116, permitting the trigger valve plunger 148 to resume the position shown in FIG. 16. Consequent movement of the planar member 158, the gear track 160 and the gear 168 does not affect the locking member 184, inasmuch as the annular ratchets 172, 178 are not in interlocking engagement. Accordingly, the locking member 184 is urged by the spring 190 into engagement with the timer bar 198. In due course, the timer bar recess 206 aligns with the locking member at which point the locking member re-enters the recess 206.

The rearward movement of the distal end of the swing bar 240 carries with it the connector 250, as above discussed, moving the switch actuating arm 216 out of the path of the rearwardly-moving timer bar. Subsequently, when the cover member 8 is lowered, and thus the distal end of the swing bar 240 is moved forward, the connector 250 is drawn back into the reel 252 to return the microswitch to the position shown in FIG. 11. At this point, the apparatus is again at rest and ready for another cycle of operation.

Thus, there is provided a toilet apparatus having means for automatically washing and drying the bowl rim and seat member surfaces. The apparatus is further provided with a control means which permits the apparatus to be used without the washing and drying feature, if desired. The apparatus is still further provided with sealing means, whereby the water used in the washing operation is confined to the interior of the apparatus.

It is to be understood that the present invention is by no means limited to the particular constructions herein disclosed and/or shown in the drawings, but also comprises any modifications or equivalents within the scope of the disclosure.

Having thus described my invention, what I claim as new and desire to secure by Letters Patent of the United States is:

1. In a toilet apparatus comprising a bowl, a seat member adapted to overlie rim portions of said bowl, and a cover member adapted to overlie said seat member, the improvement comprising a channel disposed in said cover member, a plurality of holes extending from said channel to undersurface portions of said cover member overlying said seat member, first fluid conveying means interconnecting fluid source means with said cover member channel, a channel disposed in said seat member, a plurality of holes extending from said seat member channel to undersurface portions of said seat member overlying said bowl rim portions, second fluid conveying means interconnecting said fluid source means with said seat member channel, said fluid source means comprising a tank adapted to retain liquid therein and said first and second fluid conveying means comprising pipe means for said liquid, said fluid source means further comprising a gas source said first and second fluid conveying means further comprising said pipe means for said gas, and a control unit for initiating flow of said liquid through said liquid conveying pipe means, terminating said flow of said liquid, initiating operation of a valve means for said gas, and operation of said valve means to terminate said flow of said gas, whereby to cause liquid to flow through said cover member channel and said seat member channel and said cover member holes and said seat member holes and be directed onto said upper surfaces of said seat member and said bowl rim portions, and thereafter to cause gas to flow through said cover member channel and said seat member channel and said cover member holes and said seat member holes and be directed onto said upper surfaces of said seat member and said bowl rim portions, said flow of liquid being operable to wash said upper surfaces of said seat member and said bowl rim portions, and said flow of gas being operable to purge said cover member channel, said seat member channel, said cover member holes, and said seat member holes of said liquid and further operable to dry said upper surface of said seat member and aid bowl rim portions.

2. The invention in accordance with claim 1, in which said control unit comprises housing means, said liquid conveying means extending from said water source and disposed in said housing means, said valve means in said housing means for facilitating communication of said liquid conveying means with said channels said gas conveying means from said gas source disposed in said housing means, said valve means being further adapted to facilitate communication of said gas conveying means with said channels, and means for actuating conveyance of said gas after completion of conveyance of said liquid.

3. The invention in accordance with claim 2 in which said valve means comprises a slidable plunger moveable between first and second positions, said first position being adapted to permit passage of liquid therethrough via a first portion thereof while obstructing passage of gas through a second portion thereof, and said second position being adapted to permit passage of said gas through said second portion while substantially obstructing passage of said liquid through said first portion.

4. The invention in accordance with claim 3 in which said plunger is spring biased toward said second position, but adapted to be moved to said first position by said liquid bearing thereagainst.

5. The invention in accordance with claim 4 in which said control unit further comprises a spring-biased timer bar slidably moveable on a timer track and engageable with switch means to activate flow of said gas, and a locking member adapted to restrain said timer bar from movement on said timer track, said plunger being operable when moving to said second position from said first position to release said timer bar, whereby to permit said timer bar to move under the influence of said spring bias to engage said switch means to activate said flow of gas.

6. The invention in accordance with claim 1, including a sealing assembly for preventing escape of said fluid from a chamber formed by said bowl, said seat member, and said cover member, said assembly comprising a housing fixed to the exterior of said bowl proximate said rim surface, and a slide member disposed in said housing, said slide member being selectively moveable to a first position in said housing in which said slide member is removed from said rim surface and to a second position extending from said housing in which an upper surface of said slide member abuts an undersurface of said cover member to effect a seal therebetween.

7. The toilet apparatus according to claim 6 including a projection extending inwardly of said housing from a vertical wall thereof, a slide member disposed in said housing, said slide member having elongated slot means therein, said projection extending through said slot means such that a portion of said projection is disposed in said slide member dividing said slide member into upper and lower chambers, an inflatable upper tube disposed in said upper chamber, an inflatable lower tube disposed in said lower chamber, and means for selectively inflating one of said tubes while deflating the other of said tubes, whereby to move said slide member in said housing selectively downwardly to said first position removed from said rim surface, or upwardly to said second position in which said upper surface of said slide member abuts said undersurface of said cover member to effect said seal therebetween.

* * * * *